United States Patent [19]

Fritzenwenger et al.

[11] 4,425,877

[45] Jan. 17, 1984

[54] COOLING ARRANGEMENT FOR LIQUID COOLED INTERNAL COMBUSTION ENGINES

[75] Inventors: Josef A. Fritzenwenger, Anzing; Martin Probst; Gunther Schmid, both of Munich, all of Fed. Rep. of Germany

[73] Assignee: Bayerische Motoren Werke Aktiengesellschaft, Munich, Fed. Rep. of Germany

[21] Appl. No.: 363,145

[22] Filed: Mar. 29, 1982

[30] Foreign Application Priority Data

Mar. 27, 1981 [DE] Fed. Rep. of Germany ..... 3112202

[51] Int. Cl.[3] ..... F01P 7/16

[52] U.S. Cl. ..... 123/41.1; 236/34.5

[58] Field of Search ..... 123/41.08, 41.09, 41.1; 165/36, 51, 10 B; 236/34.5, 101 C

[56] References Cited

U.S. PATENT DOCUMENTS

| | | | |
|---|---|---|---|
| 1,400,925 | 12/1921 | Wolf | 123/41.1 |
| 1,408,995 | 3/1922 | Emory | 123/41.1 |
| 3,255,740 | 6/1966 | Walsh | 236/34.5 |
| 4,022,377 | 5/1977 | Wagner et al. | 236/34.5 |
| 4,320,798 | 3/1982 | Obernberger | 123/41.09 |

*Primary Examiner*—William A. Cuchlinski, Jr.
*Attorney, Agent, or Firm*—Craig & Burns

[57] ABSTRACT

A cooling arrangement for liquid-cooled internal combustion engines, with the cooling arrangement including a heat exchanger constructed as a radiator for effecting cooling between air and a coolant liquid. The cooling arrangement includes a housing accommodating a thermostat with a mixing chamber, defined in the housing, being connected with a return flow coolant tank. The thermostat is adapted to provide for temperature dependent regulated portions of cooled and uncooled liquid coolant flowing into the mixing chamber. The housing of the thermostat, a bypass connection piece, and an outlet connection of the housing are molded, in one piece to the return flow coolant tank of the heat exchanger. A lid or cover provided with recesses as well as window-like openings formed in a portion of the housing form an inside connection between the return flow coolant tank and the mixing chamber with the connection being controlled by a radiator valve disk of a thermostat insert of the thermostat.

11 Claims, 2 Drawing Figures

COOLING ARRANGEMENT FOR LIQUID COOLED INTERNAL COMBUSTION ENGINES

The present invention relates to a cooling arrangement and, more particularly, to a cooling system for internal combustion engines with the cooling system including a heat exchanger and a bypass extending parallel to the heat exchanger, along with a mixing chamber for a cooled and uncooled portion of the cooling liquid in a thermostat for enabling a temperature-dependent proportional throughflow regulation by means of the heat exchanger and bypass circuit. The mixing chamber is arranged, as viewed in a flow direction of the cooling liquid, at a distance from an outlet side of the heat exchanger and the thermostat is arranged in the mixing chamber. The thermostat is adapted to ultimately control each inlet opening into the mixing chamber so that, on the one hand, the mixing chamber is connected with the heat exchanger and, on the other hand, with the bypass.

A cooling arrangement or system of the aforementioned type is proposed in, for example, German Offenlengungsschrift No. 29 16 691, with the cooling arrangement being constructed, in particular, for engines of watercraft such that the arrangement is intended and is possible only for use with liquid cooled internal combustion engines with combined cooling by means of engine coolant and an external coolant.

The aim underlying the present invention essentially resides in providing a cooling arrangement or a cooling system of the aforementioned type wherein a thermostat is integrated in the heat exchanger for liquid cooled internal combustion engines, in particular, with internal combustion engines powering motor vehicles.

In accordance with advantageous features of the present invention, a radiator for a motor vehicle is provided and constructed as a heat exchanger for air and cooling liquid, with the heat exchanger being provided with a forward flow and a return flow tank, and with the mixing chamber being arranged at the return flow water tank. An inlet opening, leading to the mixing chamber, is connected with the heat exchanger and is, with respect to the normal direction of flow of the coolant, connected with an inside of the return flow water tank. By virtue of these features, it is possible to use the cooling system of the present invention with all liquid-cooled internal combustion engines.

In accordance with further advantageous features of the present invention, a removable lid or cover is attached to an outside of a housing of the thermostat, with the lid or cover being arranged at a position opposite an inlet opening of the mixing chamber. The lid closes off an installation opening for the thermostat, with an inlet opening of the mixing chamber opposite the lid or cover leading into a bypass connection piece which, as with the outlet connection of the mixing chamber, is arranged on an outside of the return flow water tank.

In accordance with further features of the present invention, an entrance chamber, the mixing chamber, and the bypass connection piece are constructed as coaxial cylindrical sections that decrease in diameter in the order of the entrance chamber, mixing chamber, and bypass connection piece. At least one of the entrance chamber, mixing chamber, and bypass connection is fashioned or formed in one piece to the outside of the return flow water tank and protrude outwardly therefrom. Preferably, at least one of the entrance chamber, mixing chamber, and bypass connection piece are formed or fashioned on the outside wall in one piece to the return flow water tank. A joint center axis of the cylindrical sections forming the entrance chamber, mixing chamber, and bypass connection piece extend substantially parallel to an air flow direction through a cooling area of the cooling system and to a lateral outside wall of the return flow water tank at a position just barely outside an extension of the outside wall. The entrance chamber with the lid or cover is arranged on a front side and the bypass connection piece is arranged on the back side of the return flow water tank. An outlet connection leading to the mixing chamber is also fashioned or formed in one piece with an outside wall of the return flow water tank.

Advantageously, according to the present invention, the entrance chamber to the mixing chamber for the cooled portion of the cooling liquid is connected to the return flow water tank by way of window-like openings provided in a partition between an inside of the return flow water tank and a housing of the thermostat. Moreover, the mixing chamber, for enabling a connection with an inside of the return flow water tank, is provided with a narrow vent which is arranged at a point of the mixing chamber that, in an installed position, is disposed on a topside.

Advantageously, the return flow water tank, the entrance chamber, the mixing chamber, the bypass connection piece, the outlet connection for the mixing chamber, and an installation opening with a mounting flange for the cover or lid are constructed as a one-piece plastic injection-molded part.

By virtue of the above-noted features of the present invention, it is possible to utilize the cooling system with customary radiators with heat exchangers between the ambient air and the engine coolant while nevertheless maintaining the construction expenses of such a cooling system or arrangement especially low since the return-flow water tank of the radiator with the housing of the thermostat, with the exception of the lid or cover may be produced as a one-piece easily injection-molded plastic part.

Accordingly, it is an object of the present invention to provide a cooling system for liquid cooled internal combustion engines which avoids, by simple means, shortcomings and disadvantages encountered in the prior art.

Another object of the present invention resides in providing a cooling system for liquid cooled internal combustion engines which is simple in construction and therefore relatively inexpensive to manufacture.

Yet another object of the present invention resides in providing a cooling system for liquid-cooled internal combustion engines by which it is possible to use customary radiators with a heat exchange between ambient air and engine coolant.

A still further object of the present invention resides in providing a cooling arrangement for liquid-cooled internal combustion engines which functions reliable under all operating temperature conditions of the engine.

These and other objects, features, and advantages of the present invention will become more apparent from the following description when taken in connection with the accompanying drawings which shows, for the purposes of illustration only, one embodiment in accordance with the present invention, and wherein.

Figure 1:
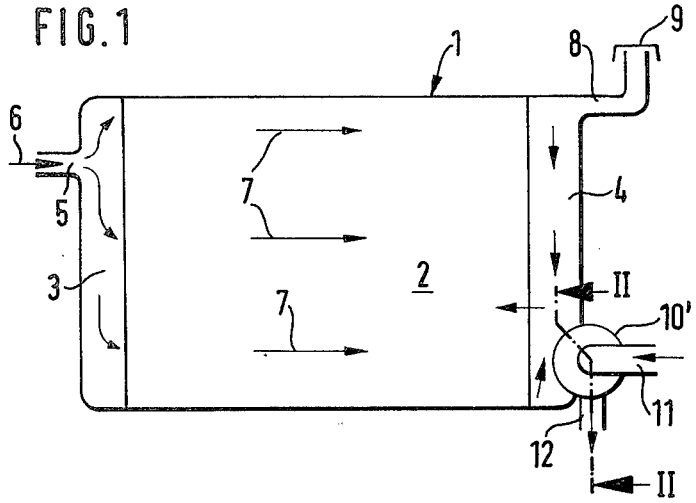
FIG. 1 is a schematic view of a cross-flow radiator for an internal combustion engine with a thermostatic means arranged at a return-flow water tank in accordance with the present invention.

Referring now to the drawings wherein like reference numerals are used in both views to designate like parts and, more particularly, to FIG. 1, according to this figure, a heat exchanger generally designated by the reference numeral 1 for air and cooling liquid is constructed as a cross-flow radiator such as, for example, a radiator for internal combustion engines of motor vehicles, especially passenger motor vehicles and motorcycles or bikes. The heat exchanger 1 includes a cooling area 2 with a forward flow water or coolant tank 3 provided on one side of the cooling area 2 and a return flow water or coolant tank 4 disposed on the other side of the cooling area 2. An inlet connection 5 is connected to a forward-flow pipe (not shown) in a conventional manner, with the inlet connection 5 extending into the forward flow water tank 3. The forward flow pipe supplied coolant in a direction of the arrow 6 from an internal combustion engine (not shown) to the heat exchanger 1. The coolant flows horizontally through the cooling area in the direction of the arrows 7 and, in the process of such flow, heat to be eliminated is transferred from the cooling liquid to the cooling air which flows through the cooling area in a direction perpendicular to the plane of the drawing. A filler connection 8 is provided on a top side of the return flow water tank 4, with a cap or lid 9, provided with conventional excess-pressure and low pressure valves (not shown) being provided on the cap or lid 9 so as to enable the cap or lid 9 to sealingly close the inlet opening of the filler connection 8.

Figure 2:
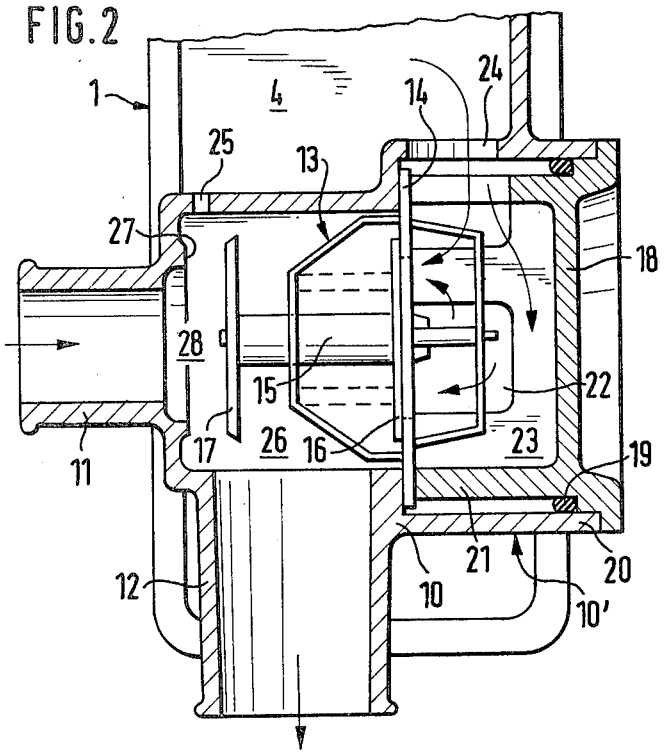
FIG. 2 is a longitudinal cross sectional view taken along the line II—II of FIG. 1 of the thermostat means which is molded or formed in one piece to the return flow water tank of the cross flow radiator.

As shown most clearly in FIG. 2, a housing 10 accommodates a thermostat 10′, with the housing being molded or fashioned to a bottom side of the return flow water tank 4. The housing 10 includes an essentially multicylindrical stepped interior cross section with a bypass connection 11 and an outlet connection 12 being formed in one piece with the housing 10. A longitudinal center axis of each of the cylindrical sections of the multicylindrical interior of the housing 10 are disposed concentrically with respect to one another and the longitudinal center axis of the bypass connection piece 11. The axes of the cylinder sections are arranged in a direction of the airflow that extends away from a plane of the drawing. The outlet connection 12 extends radially downwardly with respect to the housing 10; however, it is also possible for the outlet connection 12 to extend to the side of the housing 10 or possibly diagonally to the side and downwardly in accordance with an extension portion of a return-flow pipe or conduit (not shown) leading to the internal combustion engine.

The housing 10 accommodating the thermostat 10′ includes a conventional thermostat insert generally designated by the reference numeral 13. The thermostat insert 13 is provided with a mounting flange 14, a radiator valve opening, an wax element 15, a radiator valve disc 16, and a bypass valve disc 17. For sealing purposes, the mounting flange 14 is clamped against a stepped arrangement of the multicylindrical interior cross section of the housing 10 by a lid or cover 18. For this purpose, the lid or cover 18 includes a flange connection (not shown) and, axially extending projections 21 are arranged in a crown shaped manner about the lid or cover 18. Front sides of the projections 21 rest on the mounting flange 14 of the thermostat insert 16, with the cover or lid further including window-like recesses 22 which form inlet openings for enabling a coolant liquid to flow into entrance chamber 23 of the housing 18. A sealing ring 19 is disposed at an end section 20 of the housing 10 for sealing the interior of the housing with respect to the outside thereof.

Window-like openings 24 are associated with the recesses 22 in a partition between the housing 10 and an inside of the return flow water tank 4. A narrow vent or opening 25, connects the interior cross section of the housing 10, which interior cross section serves as a mixing chamber, with a point of connection of the vent or opening 25 being arranged such that, in an operating or installed condition of the housing, the opening is disposed at a top thereof and commmunicates with an interior of the return flow water tank 4. The multicylindrical or step like arrangement of the interior cross section of the housing 10 from the mixing chamber 26 to the bypass connection pieces 11 forms a valve seat 27 of an inlet opening 28 of the mixing chamber 26.

The return flow water tank, together with the housing 10 of the thermostat 10′, may be formed in one piece of a metal or plastic material by, for example, die casting or injection molding so that manufacturing cost as well as the weight of the cooling system or arrangement of the present invention are relatively low. Such a proposed construction of the cooling arrangement or system is aided by the fact that the housing 10 of the thermostat 10′, in contrast to a customary arrangement of a housing of a thermostat for internal combustion engines, is not subjected to a maximum temperature of the engine but, at the most extreme point, to a maximum temperature of the coolant liquid which is much lower than the maximum temperature of the engine thereby enabling the use of cost effective plastic material to form the housing and components of the thermostat of the present invention.

While we have shown and described only one embodiment in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A cooling arrangement for a liquid cooled internal combustion engine, the cooling arrangement comprising a heat exchanger means, a bypass means extending in parallel to said heat exchanger means, a mixing chamber means for accommodating a cooled and uncooled portion of a coolant, a thermostat means for radiating a flow of coolant through the heat exchanger means and the bypass means in dependence upon a temperature of the coolant, mixing chamber means is arranged at an outlet side of the heat exchanger means in a normal flow direction of the coolant, the thermostat means is arranged in the mixing chamber means and is adapted to selectively control at least one inlet opening into the mixing chamber means such that the mixing chamber means is connected ultimately with the heat exchanger means and the bypass means and characterized in that the thermostat means further includes a coolant entrance chamber means defined in the housing, the coolant entrance chamber means is adapted to be brought into communication with the mixing chamber means by the thermostat means, the entrance chamber means, mixing chamber means, and bypass means are formed by a plurality of cylindrical sections having decreasing diameters, a longitudinal center axis of each of the cylindrical sections forming the entrance chamber means, mixing chamber means, and bypass means are coincidental and extend substantially parallel to an air flow direction through the cooling area and at a position spaced from an outside of an extension of an outside wall of the return flow coolant tank means, the entrance chamber means is defined by the housing means and the cover means, the entrance chamber means and the cover means are arranged on the front side whereas the bypass means are arranged on the back side of the return flow coolant tank means as viewed in a flow direction of the coolant and in that the discharge opening of the mixing chamber means is arranged on an outside wall of the return flow coolant tank means.

2. A cooling arrangement according to claim 1, characterized in that the discharge opening of the mixing chamber means is molded in one piece with the outside wall of the return flow coolant tank means, at least some of the plurality of cylindrical sections are molded in one piece with an outside wall of the return flow coolant tank means, and in that the cylindrical sections decrease in diameter from the entrance chamber means, mixing chamber means, and bypass means.

3. A cooling arrangement according to claim 2, characterized in that the housing extends into the return flow coolant tank means and forms a partition between the interior of the housing and the return flow coolant tank means, the at least one inlet opening includes at least one window like opening provided in the partition for communicating the entrance chamber means with the interior of the return flow coolant tank means.

4. A cooling arrangement according to claim 3, wherein one narrow opening is provided in the partition for communicating the mixing chamber means with the interior of the return flow coolant tank means, and characterized in that the one narrow opening is arranged so as to be disposed on a top of the housing when the housing is in a normal installed position.

5. A cooling arrangement according to claim 1, characterized in that the return flow coolant tank means, the entrance chamber means, the mixing chamber means, the bypass means, the discharge opening, the installation opening, and a mounting flange for the cover means are formed as a one piece injected molded part of a plastic material.

6. A cooling arrangement for a liquid cooled internal combustion engine, the cooling arrangement comprising a heat exchanger means, a bypass means extending in parallel to said heat exchanger means, a mixing chamber means for accommodating a cooled and uncooled portion of a coolant, a thermostat means for radiating a flow of coolant through the heat exchanger means and the bypass means in dependence upon a temperature of the coolant, mixing chamber means is arranged at a distance from an outlet side of the heat exchanger means in a normal flow direction of the coolant, the thermostat means is arranged in the mixing chamber means and is adapted to selectively control at least one inlet opening into the mixing chamber means such that the mixing chamber means is connected ultimately with the heat exchanger means and the bypass means, the heat exchanger means is constructed as a radiator including a forward flow coolant tank means and a return flow coolant tank means arranged on respective sides of the cooling area of the heat exchanger means, the mixing chamber means is arranged at a return flow tank means, wherein at least one inlet opening into the mixing chamber means is connected, as viewed in a normal flow direction of the coolant, with an interior of the return flow coolant tank means, the thermostat means includes a housing, a thermostat insert means is accommodated in the houising, an installation opening is provided in the housing for enabling an insertion of the thermostat insert means into the housing, a further inlet opening is provided in the housing for communicating the mixing chamber means with the bypass means, a cover means is arranged opposite the further inlet opening for sealing off the installation opening, wherein the further inlet opening and a discharge opening of the mixing chamber means are disposed on an outside of the return flow coolant tank means, and wherein the thermostat means further includes a coolant entrance chamber means defined in the housing, the coolant entrance chamber means is adapted to be brought into communication with the mixing chamber means by the thermostat means, the entrance chamber means, mixing chamber means, and bypass means are formed by a plurality of cylindrical sections having decreasing diameters, a longitudinal center axis of each of the cylindrical sections forming the entrance chamber means, mixing chamber means, and bypass means are coincidental and extend substantially parallel to an air flow direction through the cooling area and at a position spaced from an outside of an extension of an outside wall of the return flow coolant tank means, the entrance chamber means is defined by the housing means and the cover means, the entrance chamber means and the cover means are arranged on the front side whereas the bypass means are arranged on the back side of the return flow coolant tank means as viewed in a flow direction of the coolant, and the discharge opening of the mixing chamber means is arranged on an outside wall of the return flow coolant tank means.

7. A cooling arrangement according to claim 6, characterized in that the discharge opening of the mixing chamber means is molded in one piece with the outside wall of the return flow coolant tank means, at least some of the plurality of cylindrical sections are molded in one piece with an outside wall of the return flow coolant tank means, and in that the cylindrical sections decrease in diameter from the entrance chamber means, mixing chamber means, and bypass means.

8. A cooling arrangement according to claim 7, characterized in that the housing extends into the return flow coolant tank means and forms a partition between the interior of the housing and the return flow coolant tank means, the at least one inlet opening includes at least one window like opening provided in the partition for communicating the entrance chamber means with the interior of the return flow coolant tank means.

9. A cooling arrangement according to claim 8, characterized in that at least one narrow opening is provided in the partiton for communicating the mixing chamber means with the interior of the return flow coolant tank means.

10. A cooling arrangement according to claim 9, characterized in that the at least one narrow opening is arranged so as to be disposed on a top of the housing when the housing is in a normal installed position.

11. A cooling arrangement according to one of claims 6, 7, 8, 9, or 10, characterized in that the return flow coolant tank means, the entrance chamber means, the mixing chamber means, the bypass means, the discharge opening, the installation opening, and a mounting flange for the cover means are formed as a one piece injected molded part of a plastic material.

* * * * *